US011136766B2

(12) United States Patent
Li et al.

(10) Patent No.: US 11,136,766 B2
(45) Date of Patent: Oct. 5, 2021

(54) EASY-TO-ASSEMBLE PANEL

(71) Applicant: JIANGSU LANGYUE NEW MATERIALS TECHNOLOGY CO., LTD., Zhenjiang (CN)

(72) Inventors: Guoping Li, Zhenjiang (CN); Bin Wu, Zhenjiang (CN)

(73) Assignee: JIANGSU LANGYUE NEW MATERIALS TECHNOLOGY CO., LTD., Zhenjiang (CN)

( * ) Notice: Subject to any disclaimer, the term of this patent is extended or adjusted under 35 U.S.C. 154(b) by 0 days.

(21) Appl. No.: 16/872,355

(22) Filed: May 11, 2020

(65) Prior Publication Data

US 2020/0362568 A1 Nov. 19, 2020

Related U.S. Application Data

(63) Continuation of application No. PCT/CN2019/090637, filed on Jun. 11, 2019.

(30) Foreign Application Priority Data

May 18, 2019 (CN) ..... 201910415634.6

(51) Int. Cl.
*E04F 15/02* (2006.01)
*E04C 2/40* (2006.01)

(52) U.S. Cl.
CPC ..... *E04F 15/02038* (2013.01); *E04C 2/40* (2013.01); *E04F 2201/0153* (2013.01)

(58) Field of Classification Search
CPC ..... E04F 15/02038; E04F 2201/0153; E04F 13/0894; E04F 2201/0107
USPC ..... 52/591.4
See application file for complete search history.

(56) References Cited

U.S. PATENT DOCUMENTS 7,568,322 B2 * 8/2009 Pervan ..... E04F 15/04 52/792.11
8,061,104 B2 * 11/2011 Pervan ..... E04F 15/02038 52/592.1
8,397,459 B2 * 3/2013 Gately ..... E04F 13/0801 52/539
9,885,187 B2 * 2/2018 Kell ..... E04F 15/02038
10,072,428 B2 * 9/2018 Devos ..... E04F 15/02038
(Continued)

FOREIGN PATENT DOCUMENTS

CN 1370904 A 9/2002
CN 101278099 A 10/2008
(Continued)

*Primary Examiner* — Adriana Figueroa

(57) ABSTRACT

The present application relates to the technical field of assembled panels in buildings, and discloses an easy-to-assemble panel. In one embodiment, an extension block is provided on a side surface of one side of the splicing panel, a convex block is provided on a side surface of the other side of the splicing panel, and a self-adhesive layer is provided on a bottom surface of the splicing panel. A limiting groove is formed between a bottom wall of the extension block and the side surface, close to the extension block, of the splicing panel. An engaging block is provided at one end, away from the splicing panel, of the extension block, and an engaging groove matching with the engaging block is provided in the side surface, close to the convex block, of the splicing panel.

8 Claims, 9 Drawing Sheets

(56) References Cited

U.S. PATENT DOCUMENTS

| | | | | |
|---|---|---|---|---|
| 10,287,777 | B2 * | 5/2019 | Boo | E04F 15/105 |
| 10,309,113 | B2 * | 6/2019 | Devos | E04F 15/02038 |
| 10,329,776 | B2 * | 6/2019 | Meersseman | E04F 15/02038 |
| 10,612,248 | B2 * | 4/2020 | Hannig | E04F 15/02033 |
| 10,648,182 | B2 * | 5/2020 | De Rick | E04F 15/02038 |
| 2005/0144878 | A1 * | 7/2005 | Grafenauer | E04F 15/02033<br>52/578 |
| 2005/0241255 | A1 | 11/2005 | Kim | |
| 2016/0060878 | A1 * | 3/2016 | Everhart, II | E04F 13/148<br>52/588.1 |
| 2019/0024388 | A1 * | 1/2019 | Devos | E04F 15/107 |
| 2020/0141123 | A1 * | 5/2020 | Hurtubise | E04F 13/0894 |
| 2020/0318360 | A1 * | 10/2020 | De Rick | E04F 15/02038 |
| 2020/0378136 | A1 * | 12/2020 | Hannig | E04F 15/02038 |

FOREIGN PATENT DOCUMENTS

| | | | | |
|---|---|---|---|---|
| CN | 101725239 | A | 6/2010 | |
| CN | 104220682 | A | 12/2014 | |
| CN | 106032696 | A | 10/2016 | |
| CN | 108643512 | A | 10/2018 | |
| DE | 19929896 | A1 * | 1/2001 | E04F 15/04 |
| JP | 2012112142 | A | 6/2012 | |

* cited by examiner

EASY-TO-ASSEMBLE PANEL

CROSS-REFERENCE TO RELATED APPLICATION

This application is a Continuation Application of PCT Application No. PCT/CN2019/090637, filed on Jun. 11, 2019, which claims the priority benefit of Chinese Patent Application No. 201910415634.6, filed on May 18, 2019. The entirety of each of the above-mentioned patent applications is hereby incorporated by reference herein and made a part of this specification.

TECHNICAL FIELD

The present application relates to the technical field of assembled panels in buildings, in particular to an easy-to-assemble panel.

DESCRIPTION OF RELATED ART

A floorboard is a building material used for the floor of a house or for the surface layer of a building, a wallboard is a material used for the surface of a wall, and they are both typically made of wood or other processed plates. Paving a floorboard/wallboard of large-area is to lay small panels on a floor/wall surface, and before laying the splicing panels onto the floor/wall surface, a user usually needs to apply a layer of adhesive to the back surfaces of the splicing panels at first, and thereafter bonds the splicing panels to the floor/wall surface. However, this way of gluing floor panels is expensive and also not environmental-friendly, and therefore needs to be improved.

In order to solve the problems, the current floorboard manufacturers have proposed different floorboard assembly solutions, for example:

D1: Chinese Patent Publication No. CN106032696A disclosed a floorboard assembly comprising a plurality of splicing floorboard panels and a plurality of fasteners, wherein each splicing floorboard panel includes a generally rectangular main body, a rib and an inserting groove are provided at two opposite sides of the main body, respectively, a first pressing block and a second pressing block are provided below the rib and the inserting groove, respectively, and a recess and a step are concavely formed above the outer sides of the first pressing block and the second pressing block, respectively; each fastener comprises a base plate, a front baffle and a rear baffle protruding upwards are provided at two opposite sides of the top surface of the base plate, a partition plate protruding upwards is provided between the front baffle and the rear baffle, and the top of the partition plate is provided with a fastening piece which is bent towards the rear baffle. By means of the engaging of the rib and the inserting groove and the hooking of the fastening piece and the recess or step, the splicing floorboard panels of the floorboard assembly can be stably combined.

D2: Chinese Patent Publication No. CN104220682A discloses building panels of solid wood. Each building panel comprises a first upper element of solid wood fixed to a second lower element of solid wood. The building panels are provided with a mechanical locking system, which comprises a locking strip, at a first edge of a first building panel 1. The locking strip is provided with a locking element configured to cooperate with a locking groove, at a second edge of a second building panel for horizontal locking of the first and the second building panels when a tension force is applied.

It can be seen from the above-mentioned documents that at present, there are relatively established technical solutions for stable connection between splicing floorboard panels/building panels (which can be wall panels) by means of separate fasteners or by means of cooperation of locking elements and locking grooves. However, when the panels (splicing floorboard panels/building panels) are connected by using the above-mentioned separate fasteners or locking structures, splicing tools are needed to perform the connection, for example, if the separate fasteners are used, a tool such as a hammer and the like is needed for engaging the fasteners into grooves of corresponding splicing floorboard panels. If the locking structures are used, an assembling tool such as a hammer is needed to engaging the locking element on one splicing floorboard panel into the locking groove in another splicing floorboard panel, which costs both time and labor and is difficult to perform.

SUMMARY OF THE APPLICATION

The present application provides an easy-to-assemble panel which is advanced by easy assembling.

In one embodiment, the present application provides the following technical solution:

an easy-to-assemble panel comprises a splicing panel. an extension block is provided on a side surface of one side of the splicing panel, a convex block is provided on a side surface of the other side of the splicing panel, and a self-adhesive layer is provided on a bottom surface of the splicing panel; a limiting groove is formed between a bottom wall of the extension block and the side surface, close to the extension block, of the splicing panel, and the limiting groove matches with the convex block; an engaging block is provided at one end, away from the splicing panel, of the extension block, and an engaging groove matching with the engaging block is provided in the side surface, close to the convex block, of the splicing panel and positioned above the convex block; and a bevel facing the convex block is tiltedly disposed and formed on an inner side wall, close to a top surface of the splicing panel, of the engaging groove, and the bevel matches with a side surface of one side, close to the top surface of the splicing panel, of the engaging block.

By adopting the technical solution, height difference between the splicing panels can be controlled by means of engagement of the engaging blocks and the engaging grooves, so that the surface of the assembled floorboard/wallboard is flat and smooth. By providing the bevels, the engaging blocks can be easily inserted into the corresponding engaging grooves by translational or angled insertion, and after the floorboard/wallboard is assembled, the splicing panels are combined with the ground as a whole by the self-adhesive layer, so that transverse movement is prevented, providing the advantage of easy assembling. In addition, compared with installation by fasteners, the easy-to-assemble panel of the present application eliminates the use of installation tools, and the efficiency of installation is improved. Compared with a paving-by-gluing method, the easy-to-assemble panel of the present application entails no wet operation, which facilitates disassembling.

The present application is further configured such that: the engaging block is of an arc or polygonal shape.

By adopting the technical solution, the engagement of the engaging block into the corresponding engaging groove is facilitated, and the efficiency of paving floorboard/wallboard is further increased.

The present application is further configured such that: a gap is formed between the engaging block on the splicing panel and the inner side wall of the engaging groove in a corresponding splicing panel, the gap is for allowing the engaging block on the splicing panel to rotate, along with the extension block and the splicing panel, towards the outside of the engaging groove in the corresponding splicing panel by taking a top side edge of one end, close to the engaging block, of the extension block as an axis.

By adopting the technical solution, when being disassembled, the splicing panel can be rotated with the top side edge of the end, close to the engaging block, of the extension block as an axis, which facilitates disassembling. In addition, during assembling, two splicing panels can be laid by angled insertion with a larger angle of inclination, which is more user-friendly and makes the installation more comfortable.

The present application is further configured such that: a top surface of the convex block is parallel to the top surface of the splicing panel, and the bevel and the top surface of the convex block form an included angle of 10-75 degrees therebetween.

By adopting the technical solution, with a given depth of the engaging groove, a smaller angle of inclination of the bevel is favorable for reducing the size of the opening of the engaging groove such that the thicknesses of the portions, above and below the engaging groove, of the splicing panel is prevented from being too small, and the structural strength of the end, close to the engaging groove, of the splicing panel is favorably ensured.

The present application is further configured such that: the length of the convex block in the depth direction of the engaging groove is smaller than that of the extension block in the depth direction of the engaging groove, and an arc transition is provided between the top surface of the convex block and the end surface, away from the splicing panel, of the convex block.

By adopting the technical solution, when the convex block is inserted into the limiting groove in another splicing panel, the convex block does not contact with the end surface of the another splicing panel, so that damages caused by collision between the convex block and the another splicing panel can be prevented.

The present application is further configured such that: a silencing layer is provided on the bottom surface of the splicing panel, and the self-adhesive layer is disposed on a side surface, away from the splicing panel, of the silencing layer.

By adopting the technical solution, the back surface of the bottom plate is combined with a silencing layer such that the assembled floorboard/wallboard is endowed with a certain silencing effect.

The present application is further configured such that: the splicing panel comprises two long side surfaces and two short side surfaces, the extension block and the convex block are disposed on the two long side surfaces of the splicing panel, respectively, and the engaging groove extends to the two short side surfaces of the splicing panel along the length direction of the long side surfaces of the splicing panel.

By adopting the technical solution, the whole long side surface of the splicing panel is connected with the long side surface of another splicing panel, so that the stability of connection is improved. Besides, as the engaging grooves are arranged in a penetrating manner, the splicing panels can be staggered to be spliced into floorboards/wallboards with different shapes, which is more user-friendly.

The present application is further configured such that: an inserting block is provided on one short side surface of the splicing panel along the length direction of the short side surface, and a rib is provided on the other short side surface of the splicing panel along the length direction of the short side surface; a bottom surface of the rib is flush with the bottom surface of the splicing panel, and a first inserting groove matching with the inserting block is formed between a top surface of the rib and an end surface, close to the rib, of the splicing panel; and a top surface of the inserting block is flush with the top surface of the splicing panel, and a second inserting groove matching with the rib is formed between a bottom surface of the inserting block and an end surface, close to the inserting block, of the splicing panel.

By adopting the technical solution, when the engaging block on the splicing panel is inserted into the engaging groove in another splicing panel by translational or angled insertion, the inserting block corresponding to the engaging block can be engaged into the first inserting groove in the corresponding splicing panel by just laying flat the splicing panel corresponding to the engaging block and pressing the splicing panel onto the floor/wall surface, so that the connection between the short side surfaces of the splicing panels is enhanced. In addition, the smoothness between the top surfaces close to the short side surfaces of two adjacent splicing panels increased, and the height difference is favorably further reduced.

The present application is further configured such that: the length of the rib in the length direction of the long side surfaces of the splicing panel is smaller than that of the inserting block in the length direction of the long side surfaces of the splicing panel, an inward-facing surface is tiltedly disposed and formed on a side face, away from the splicing panel, of the inserting block, and the inward-facing surface and the top surface of the splicing panel form an included angle of 80-85 degrees therebetween.

By adopting the technical solution, when the floorboard/wallboard is assembled by translational or angled insertion, the inward-facing surface will not come into contact with the inner side wall of the corresponding first inserting groove, so that the resistance in assembling is favorably reduced, and the efficiency of assembling is greatly improved.

In summary, the application has the beneficial technical effects that:

1. by providing the convex block, the limiting groove, the engaging block, the engaging groove, the bevel and the self-adhesive layer, an effect of easy assembling is achieved;

2. with the bevel and the gap, the laying of a floorboard/wallboard is more user-friendly, and workers may be more comfortable and efficient in laying the floorboard/wallboard; and 3. by providing the inserting block, the rib and the inward-facing surface, the smoothness of the surface of the assembled floorboard/wallboard is favorably improved.

DETAILED DESCRIPTION OF THE APPLICATION

The present application will now be described in further detail with reference to the accompanying drawings.

Embodiment 1

Figure 1:
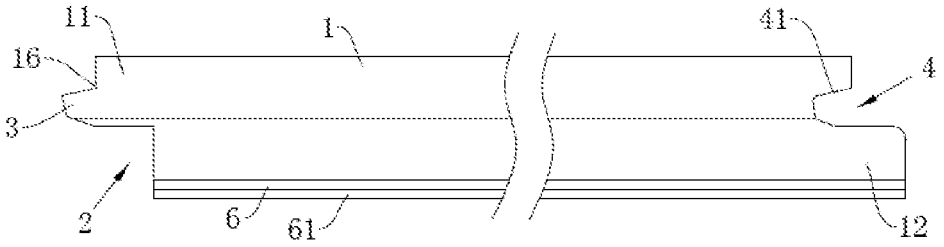
FIG. 1 is a schematic view showing the overall structure of an easy-to-assemble panel according to Embodiment 1 of the present application.

Referring to FIG. 1, the application discloses an easy-to-assemble panel comprising a splicing panel 1, an extension block 11 is integrally formed on a side surface of one side of the splicing panel 1, and a convex block 2 is integrally formed on a side surface of the other side of the splicing panel 1. Specifically, a limiting groove 2 is formed between a bottom wall of the extension block 11 and the side surface, close to the extension block 11, of the splicing panel 1, and the limiting groove 2 matches with the convex block 12, i.e. the limiting groove 2 can be inserted with the convex block 12 on another splicing panel 1. When the convex block 12 has been inserted into the corresponding limit groove 2, a top surface of the convex block 12 abuts against a bottom surface of the extension block 11.

Referring to FIG. 1, an engaging block 3 is integrally formed at one end, away from the splicing panel 1, of the extension block 11, an engaging groove 4 matching with the engaging block 3 is formed in the side surface, close to a convex block 12, of the splicing panel 1 and positioned above the convex block 12, and the distance from the splicing panel 1 to the engaging groove 4 is 0-8 mm (8 mm included and 0 mm excluded). Preferably, in this embodiment, the distance from the splicing panel 1 to the engaging groove 4 is 1.15 mm, and an inner side wall, close to the splicing panel 1, of the engaging groove 4 is flush with the top surface of the convex block 12. A bevel 41 is tiltedly disposed and formed on an inner wall, close to a top surface of the splicing panel 1, of the engaging groove 4, and the bevel 41 facing towards the convex block 12 and matches with a side surface of one side, close to the top surface of the splicing panel 1, of the engaging block 3, i.e., when the engaging block 3 is completely engaged into the engaging groove 4, the side surface of the side, close to the top surface of the splicing panel 1, of the engaging block 3 abuts against the bevel 41, so that the height difference between the splicing panels 1 assembled with each other can be controlled, and the top surfaces of the splicing panels 1 are flush with each other.

Specifically, a hook groove 16 is provided at the joint of the extension block 11 and the side wall, close to the top surface of the splicing panel 1, of the engaging block 3, and the hook groove 16 is used for preventing the side edge at the joint of the bevel 41 of the engaging groove 4 and the end surface of the splicing panel 1 from being damaged when the engaging block 3 is inserted into the corresponding engaging groove 4. A top surface of the convex block 12 is parallel to the top surface of the splicing panel 1, and the bevel 41 and the top surface of the convex block 12 form an included angle of 10-75 degrees therebetween. In this embodiment, preferably, the bevel 41 and the top surface of the convex block 12 form an included angle of 12 degree therebetween. It should be noted that in this embodiment, the engaging block 3 has a polygonal shape, and the area of one end, close to the extension block 11, of the engaging block 3 is larger than the area of the other end of the engaging block 3. In addition, the engaging block 3 may also have an arc shape, a taper shape, etc., which is not specifically limited in the present application.

Referring to FIG. 1, a silencing layer 6 is provided on the bottom surface of the splicing board 1, the self-adhesive layer 61 is disposed on a side surface, away from the splicing panel 1, of the silencing layer 6, the silencing layer 6 has a thickness of 0.5 mm-5 mm, and the adhesive sticker layer 61 has a thickness of 0.05 mm-3 mm. In this embodiment, the splicing panels 1 can be assembled into a floorboard on the ground or a wallboard on the wall. Specifically, in this embodiment, both the silencing layer 6 and the self-adhesive layer 61 have a thickness of 0.5 mm, and the silencing layer 6 is a rubber pad. It should be noted that the silencing layer 6 may also be a silicone pad, EVA foam, IXPE foam, a cork layer, PS foam or PVC foam leather or paste resin foam pad, etc., which is not specifically limited in the present application. The self-adhesive layer 61 is formed by applying any one of rubber pressure-sensitive adhesives, hot-melt non-setting adhesives, PU non-setting adhesives and other water-soluble or solvent-base non-setting adhesives to the bottom surface of the splicing board 1. In this embodiment, the self-adhesive layer 61 is formed by applying a safe and environment-friendly water-based acrylic pressure-sensitive resin T-2803 to the bottom surface of the splicing board 1, so that the floorboard/wallboard is integrated with the ground after paving, the floorboard/wallboard is prevented from moving transversely relative to the ground, and the height difference caused by uneven ground is reduced.

Figure 2:
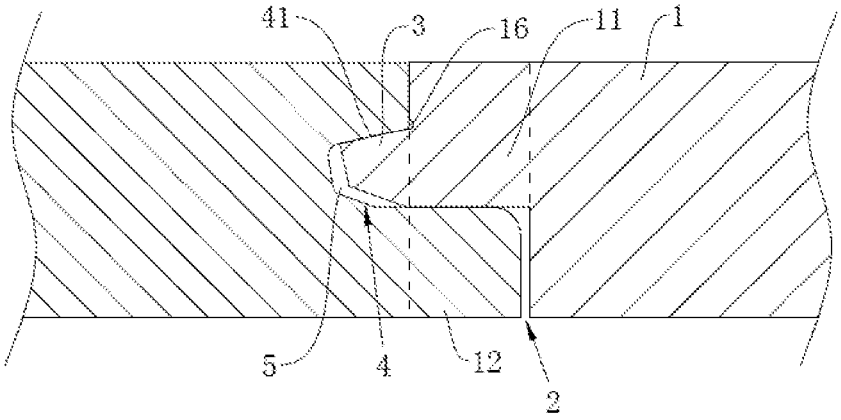
FIG. 2 is a schematic view showing a connection relationship between an engaging block and a corresponding engaging groove according to Embodiment 1 of the present application.
Figure 3:
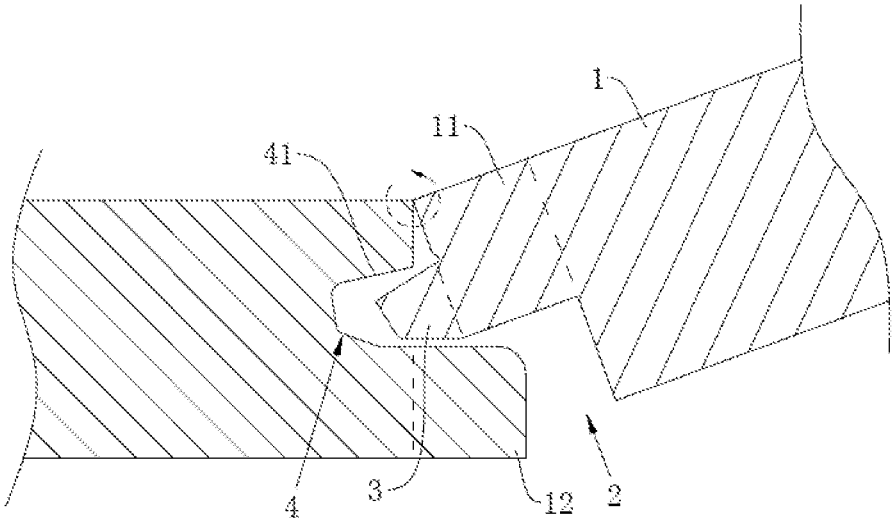
FIG. 3 is a schematic view showing the engaging block rotating towards the outside of the corresponding engaging groove according to Embodiment 1 of the present application.

Referring to FIGS. 2 and 3, the length of the convex block 12 in the depth direction of the engaging groove 4 is smaller than that of the extension block 11 in the depth direction of the engaging groove 4, and an arc transition is provided between the top surface of the convex block 12 and the end surface, away from the splicing panel 1, of the convex block 12. When the engaging block 3 on the splicing panel 1 is completely engaged into the engaging groove 4 on another splicing panel 1, a gap 5 is formed between the engaging block 3 on the splicing panel 1 and the inner wall of the engaging groove 4 in the corresponding splicing panel 1, and the gap 5 is for allowing the engaging block 3 on the splicing panel 1 to rotate, along with the extension block 11 and the splicing panel 1, towards the outside of the engaging groove 4 in the corresponding splicing panel 1 by taking a top side edge of one end, close to the engaging block 3, of the extension block 11 as an axis. i.e., the distance between the top side edge of the end, close to the engaging block 3, of the extension block 11 and each of the outer side walls of the engaging block 3 is smaller than the distance between the top surface of the extension block 11 and the bottom surface of the extension block 11. During assembly of the floorboard/wallboard, two splicing panels 1 can be installed by either translational movement or angled insertion, which is more user-friendly and makes the installation more comfortable.

Figure 4:
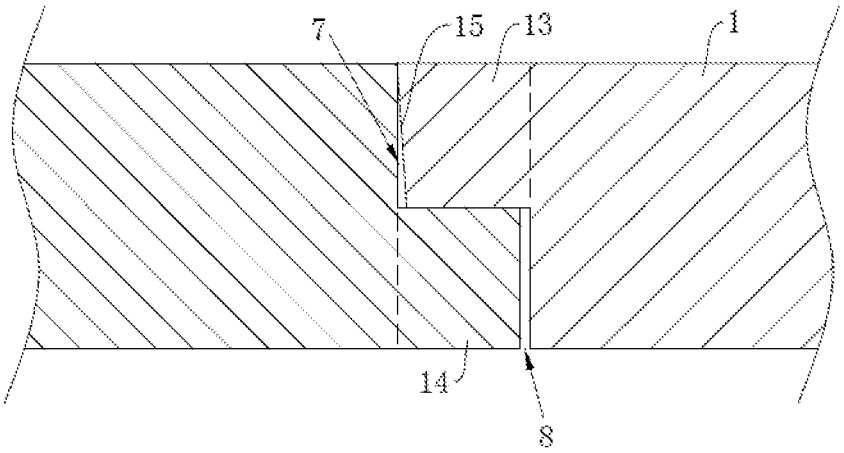
FIG. 4 is a schematic view showing a connection relationship between an inserting block and a corresponding first inserting groove according to Embodiment 1 of the present application.
Figure 5:
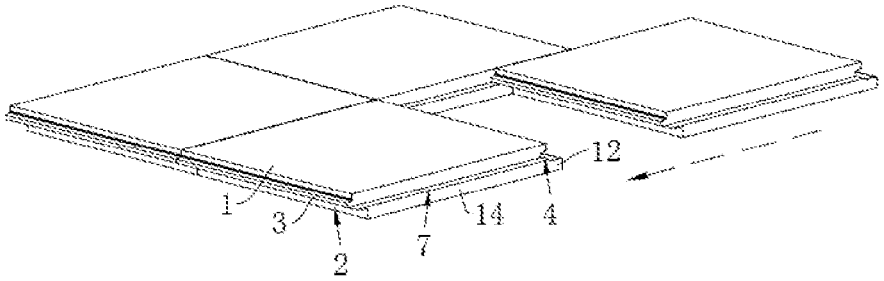
FIG. 5 is a schematic view showing a splicing panel moving transversely towards another splicing panel according to Embodiment 1 of the present application.

Referring to FIGS. 4 and 5, the splicing panel 1 comprises two long side surfaces and two short side surfaces, the extension block 11 and the convex block 12 are disposed on the two long side surfaces of the splicing panel 1, respectively, and the engaging groove 4 extends to the two short side surfaces of the splicing panel 1 along the length direction of the long side surfaces of the splicing panel 1. An inserting block 13 is provided on one short side surface of the splicing panel 1 along the length direction of the short side surface, and a rib 14 is provided on the other short side surface of the splicing panel 1 along the length direction of the short side surface, and both the inserting block 13 and the rib 14 are integrally formed with the splicing panel 1. A bottom surface of the rib 14 is flush with the bottom surface of the splicing panel 1, and a first inserting groove 7 matching with the inserting block 13 is formed between a top surface of the rib 14 and an end surface, close to the rib 14, of the splicing panel 1. A top surface of the inserting block 13 is flush with the top surface of the splicing panel 1, and a second inserting groove 8 matching with the rib 14 is formed between a bottom surface of the inserting block 13 and an end surface, close to the inserting block 13, of the splicing panel 1.

Referring to FIGS. 4 and 5, the length of the rib 14 in the length direction of the long side surfaces of the splicing panel 1 is smaller than that of the inserting block 13 in the length direction of the long side surfaces of the splicing panel 1, and when the insert 13 has been inserted into the first inserting groove 7 in the corresponding splicing panel 1, there is a spacing between the rib 14 corresponding to the first inserting groove 7 and the end surface, corresponding to the inserting block 13, of the splicing panel 1. Specifically, an inward-facing surface 15 is tiltedly disposed and formed on a side face, away from the splicing panel 1, of the inserting block 13, and the inward-facing surface 15 and the top surface of the splicing panel 1 form an included angle of 80-85 degrees therebetween, and in this embodiment, preferably, inward-facing surface 15 and the top surface of the splicing plate 1 form an included angle of 85 degrees therebetween. During assembling the floorboard/wallboard, the inserting block 13 is firstly inserted into the first inserting groove 7 in the corresponding splicing panel 1, and then the engaging block 3 is inserted into the engaging groove 4 by translational or angled insertion.

The principles of implementing this embodiment are as follow:

during assembling the floorboard/wallboard, the engaging block 3 on the long side surface of the splicing panel 1 is inserted into the engaging groove 4 in another splicing panel 1 by translational or angled insertion, then the splicing panels 1 are laid flat and pressed onto the floor/wall surface, and meanwhile, the inserting block 13 on the short side surface of the splicing panel 1 is engaged into the first inserting groove 7 of the corresponding splicing panel 1, so that the assembly is easy.

Taking a floorboard/wallboard which is assembled with four splicing panels 1 as an example (see FIG. 5), when the four splicing panels 1 are assembled, the height difference between the adjacent splicing panels 1 is controlled by means of engagement of the engaging blocks 3 and the engaging grooves 4, so that the top surface of the assembled floorboard/wallboard is flat and smooth. Moreover, the floorboard/wallboard is integrated with the ground by the self-adhesive layer 61, and therefore the floorboard/wallboard is prevented from moving transversely relative to the ground.

Embodiment 2

Figure 6:
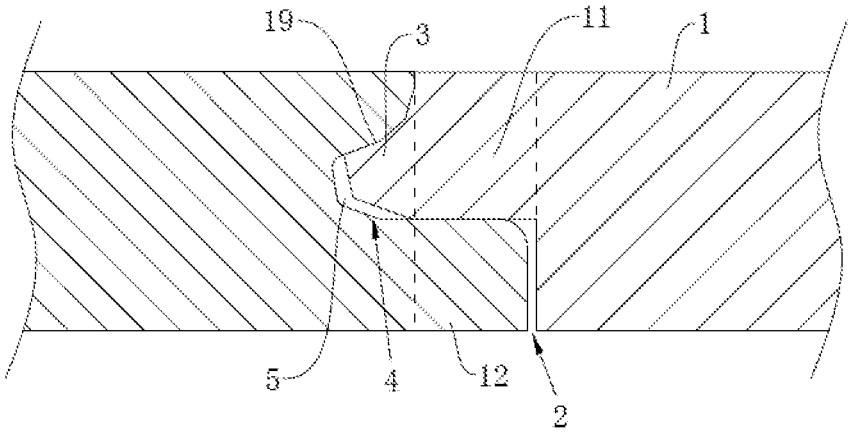
FIG. 6 is a schematic view showing a connection relationship between an engaging block and a corresponding engaging groove according to Embodiment 2 of the present application.

Referring to FIG. 6, this embodiment differs from Embodiment 1 in that: an irregular surface 19 having a multi-segment polyline shape is formed between the top side edge of one end, close to the convex block 12, of the splicing panel 1 and the bottom wall of the engaging groove 4, and the engaging block 3 at the other end of the splicing panel 1 matches with the engaging groove 4 with the irregular surface 19. It should be noted that a person skilled in the art would understand that depending on different applications, the portion between the top side edge of one end, close to the convex block 12, of the splicing panel 1 and the bottom wall of the engaging groove 4 may also have a bevel, arc or a multi-segment arc shape, which is not specifically limited in the present application.

Embodiment 3

Figure 7:
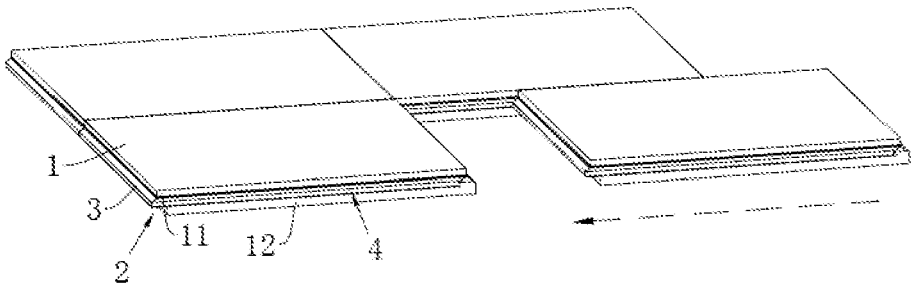
FIG. 7 is a schematic view showing a splicing panel moving transversely towards another splicing panel according to Embodiment 3 of the present application.

Referring to FIG. 7, this embodiment differs from Embodiment 1 in that: the structures on the short side surfaces of the splicing panel 1 are the same as that on the long side surfaces of the splicing panel 1, i.e., the extension block 11, the engaging block 3 and the limiting groove 2 are provided on one short side surface of the splicing panel 1, while the convex block 12 and the engaging groove 4 are correspondingly provided on the other short side surface of the splicing panel 1. During installation, the engaging block 3 on the long side surface of the splicing panel 1 is inserted into the engaging groove 4 in the long side surface of another splicing panel 1 by translational or angled insertion, then the splicing panel 1 is laid flat and meanwhile pushed to move transversely such that the engaging block 3 on the short side surface of the splicing panel 1 is engaged into the engaging groove 4 in the short side surface of the corresponding splicing panel 1, and finally the splicing panel 1 is pressed onto the floor/wall surface. Alternatively, the engaging block 3 on the short side surface of the splicing panel 1 is inserted into the engaging groove 4 in the short side surface of another splicing panel 1 by translational or angled insertion, then the splicing panel 1 is laid flat and meanwhile pushed to move transversely such that the engaging block 3 on the long side surface of the splicing panel 1 is engaged into the engaging groove 4 in the long side surface of the corresponding splicing panel 1, and finally the splicing panel 1 is pressed onto the floor/wall surface.

Embodiment 4

Figure 8:
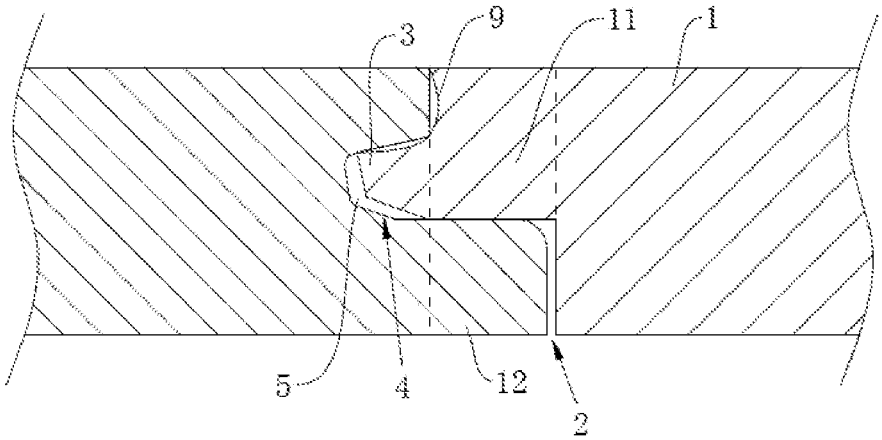
FIG. 8 is a schematic view showing a connection relationship between an engaging block and a corresponding engaging groove according to Embodiment 4 of the present application.

Referring to FIG. 8, this embodiment differs from Embodiment 1 in that: an arc transition, forming an arc surface 9, is provided between the top side edge of the end, close to the engaging block 3, of the extension block 11 and the top side edge of the end, away from the extension block 11, of the engaging block 3. By providing the arc surface 9, the engaging block 3 can be easily inserted into the corresponding engaging groove 4.

Embodiment 5

Figure 9:
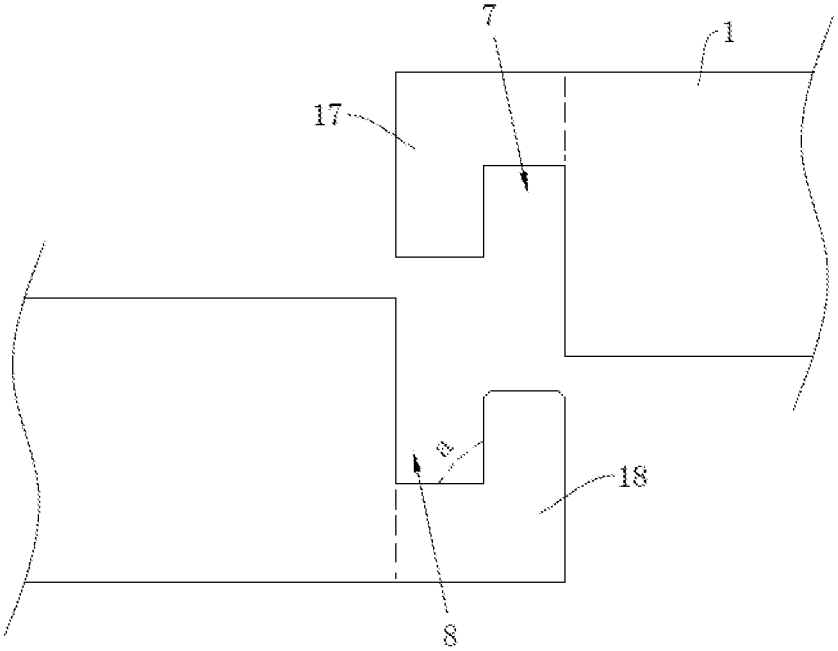
FIG. 9 is a schematic view showing a connection relationship between an inserting block and a corresponding first inserting groove according to Embodiment 5 of the present application.

Referring to FIG. 9, this embodiment differs from Embodiment 1 in that: a first L-shaped block 17 is arranged on one short side surface of the splicing panel 1 along the length direction of the short side surface, a second L-shaped block 18 is arranged on the other short side surface of the splicing panel 1 along the length direction of the short side surface, and the first L-shaped block 17 and the second L-shaped block 18 are integrally formed with the splicing panel 1. A top surface of the first L-shaped block 17 is flush with the top surface of the splicing panel 1, and a bottom surface of the second L-shaped block 18 is flush with the bottom surface of the splicing panel 1.

A first inserting groove 7 is formed between the first L-shaped block 17 and the corresponding splicing panel 1, and the first inserting groove 7 matches with the second L-shaped block 18. A second inserting groove 8 is formed between the second L-shaped block 18 and the corresponding splicing panel 1, and the second inserting groove 8 matches with the first L-shaped block 17.

It should be noted that the first L-shaped block 17 and the second L-shaped block 18 are similar in structure. Taking the second L-shaped block 18 as an example, a bottom wall of the second inserting groove 8 and an inner side wall, away from the corresponding splicing panel 1, of the second inserting groove 8 form an included angle a of 85-175 degrees therebetween, and in this embodiment, the included angle a is preferably 100 degrees. In addition, the bottom wall of the second inserting groove 8 is in a plane, arc or U shape, and concave or convex chamfers are formed between the top wall of the second L-shaped block 18 and each side wall of the second L-shaped block 18, so that the insertion connecting and matching between the first L-shaped block 17 and the second L-shaped block 18 are more convenient.

The embodiments of the present application are all preferred embodiments of the application, and are not intended to limit the scope of the application, so: equivalent modifications made according to structures, shapes, and principles of the application are intended to be within the scope of the application.

REFERENCE SIGNS LIST

1 splicing panel
11 extension block
12 convex block
13 inserting block
14 rib
15 inward-facing surface
16 hook groove
17 first L-shaped block
18 second L-shaped block
19 irregular surface
2 limiting groove
3 engaging block
4 engaging groove
41 bevel
5 gap
6 silencing layer
61 self-adhesive layer
7 first inserting groove
8 second inserting groove
9 arc surface

What is claimed is:

1. An easy-to-assemble panel, comprising a splicing panel, wherein the splicing panel comprises two long side surfaces, an extension block is provided on one of the two long side surfaces of the splicing panel, a convex block is provided on the other one of the two long side surfaces of the splicing panel, and a self-adhesive layer is provided on a bottom surface of the splicing panel; a limiting groove is formed between a bottom wall of the extension block and a side surface, close to the extension block, of the splicing panel, and the limiting groove matches with the convex block;

an engaging block is provided at one end, away from the splicing panel, of the extension block, and an engaging groove matching with the engaging block is provided in a side surface, close to the convex block, of the splicing panel and positioned above the convex block; and a bevel facing the convex block is tiltedly disposed and formed on an inner side wall, close to a top surface of the splicing panel, of the engaging groove, and the bevel matches with a side surface of one side, close to the top surface of the splicing panel, of the engaging block;

a hook groove is provided above the engaging block close to the top surface of the splicing panel;

a top surface of the convex block and a bottom surface of the extension block are parallel to a top surface of the splicing panel, with no recesses or protrusions thereon, and the bevel and the top surface of the convex block form an included angle of 10-75 degrees therebetween, and the top surface of the convex block abuts against the bottom surface of the extension block in a planar manner.

2. An easy-to-assemble panel according to claim 1, wherein the engaging block is of an arc or polygonal shape.

3. An easy-to-assemble panel according to claim 1, wherein a gap is formed between the engaging block on the splicing panel and an inner side wall of the engaging groove in a corresponding splicing panel, and the gap is configured for allowing the engaging block on the splicing panel to rotate, along with the extension block and the splicing panel, towards the outside of the engaging groove in the corresponding splicing panel by taking a top side edge of one end, close to the engaging block, of the extension block as an axis.

4. An easy-to-assemble panel according to claim 1, wherein a length of the convex block in a depth direction of the engaging groove is smaller than that of the extension block in a depth direction of the engaging groove, and an arc transition is provided between a top surface of the convex block and an end surface, away from the splicing panel, of the convex block.

5. An easy-to-assemble panel according to claim 1, wherein a silencing layer is provided on a bottom surface of the splicing panel, and the self-adhesive layer is disposed on a side surface, away from the splicing panel, of the silencing layer.

6. An easy-to-assemble panel according to claim 1, wherein the splicing panel comprises two short side surfaces, the engaging groove extends to the two short side surfaces of the splicing panel along a length direction of the long side surfaces of the splicing panel.

7. An easy-to-assemble panel according to claim 6, wherein an inserting block is provided on one short side surface of the splicing panel along a length direction of the short side surface, and a rib is provided on the other short side surface of the splicing panel along a length direction of the short side surface; a bottom surface of the rib is flush with a bottom surface of the splicing panel, and a first inserting groove matching with the inserting block is formed between a top surface of the rib and an end surface, close to the rib, of the splicing panel; and a top surface of the inserting block is flush with a top surface of the splicing panel, and a second inserting groove matching with the rib is formed between a bottom surface of the inserting block and an end surface, close to the inserting block, of the splicing panel.

8. An easy-to-assemble panel according to claim 7, wherein a length of the rib in a length direction of the long side surfaces of the splicing panel is smaller than that of the inserting block in a length direction of the long side surfaces of the splicing panel, an inward-facing surface is tiltedly disposed and formed on a side face, away from the splicing panel, of the inserting block, and the inward-facing surface and a top surface of the splicing panel form an included angle of 80-85 degrees therebetween.

* * * * *